US009217261B1

(12) United States Patent
Gershfeld

(10) Patent No.: US 9,217,261 B1
(45) Date of Patent: Dec. 22, 2015

(54) SYSTEM FOR EARTHQUAKE RETROFIT

(71) Applicant: Mikhail Gershfeld, Fullerton, CA (US)

(72) Inventor: Mikhail Gershfeld, Fullerton, CA (US)

( * ) Notice: Subject to any disclaimer, the term of this patent is extended or adjusted under 35 U.S.C. 154(b) by 0 days.

(21) Appl. No.: 14/496,083

(22) Filed: Sep. 25, 2014

(51) Int. Cl.

| | |
|---|---|
| ***E04B 1/98*** | (2006.01) |
| ***E04H 9/02*** | (2006.01) |
| ***E04G 23/02*** | (2006.01) |
| *E04B 1/26* | (2006.01) |

(52) U.S. Cl.
CPC ..... *E04H 9/027* (2013.01); *E04B 1/2608* (2013.01); *E04B 1/98* (2013.01); *E04G 23/0218* (2013.01); *E04B 2001/2696* (2013.01)

(58) Field of Classification Search
CPC ..... E04H 9/027; E04H 9/14; E04G 23/0218; E04B 1/26; E04B 1/2608; E04B 1/98; E04B 2001/2696
See application file for complete search history.

(56) References Cited

U.S. PATENT DOCUMENTS

| | | | | |
|---|---|---|---|---|
| 6,843,027 | B2 * | 1/2005 | Gaddie et al. | 52/92.1 |
| 7,134,252 | B2 * | 11/2006 | Thompson | 52/712 |
| 8,511,019 | B2 * | 8/2013 | Espinosa | 52/293.3 |
| 8,646,222 | B2 * | 2/2014 | Carbonaro et al. | 52/92.2 |

* cited by examiner

*Primary Examiner* — Andrew J Triggs
(74) *Attorney, Agent, or Firm* — Vladi Khiterer

(57) ABSTRACT

A system for earthquake retrofit of existing building structures uses a knee brace connected on one end to an existing stud and to an existing floor joist on the other end. An additional stud is provided for reinforcement to prevent the existing stud from failing. The capacity of all other components of the system exceed the capacity of the connections between the knee brace and the existing stud and existing floor joist, which connections act as a fuse in the event of an earthquake and fail first, thus preventing failure of other components and improving collapse capacity of the building structure.

8 Claims, 3 Drawing Sheets

SYSTEM FOR EARTHQUAKE RETROFIT

FIELD OF THE INVENTION

The present invention pertains to a system for earthquake retrofit of existing building structures that makes wood-frame buildings more robust and helps to improve their earthquake resisting capacity.

BACKGROUND OF THE INVENTION

Many wood-frame buildings built in the early 20$^{th}$ Century have ground floors used as garages with large openings on the front wall and almost no interior walls. These buildings are broadly referred to as "soft-story". They have bearing walls typically comprised of studs spaced 16" on center. The studs are designed to carry vertical load, but they are not relied on to resist lateral loads generated by the building mass during an earthquake. As such, these building structures are susceptible to ground floor collapse during an earthquake. The earthquake retrofits of the prior art are expensive, complicated and require displacement of occupants during retrofit. What is needed is an inexpensive earthquake retrofit that can be performed by persons of average skill, with minimum invasion into the existing spaces and allowing current occupants to remain in the building during construction.

SUMMARY OF THE INVENTION

The present invention satisfies this need. The system for earthquake retrofit of existing building structures according to the present invention uses existing walls and floor joists to form a frame with particular connections that if used at a ground floor significantly improve lateral resistance of the building to earthquakes. A knee brace is placed and connected on one end substantially in the middle of an existing stud and is connected to the corresponding existing floor joist on the other end. The resulting knee brace assembly forms a frame and significantly increases vertical load and adds lateral load on the stud, thus an additional stud is provided for reinforcement to prevent the existing stud from failing. The capacity of all other components of the system, such as joist and other than knee brace connections, exceed the capacity of the connections between the knee brace and the existing stud and existing floor joist by at least 30%. Therefore, these connections between the knee brace and the existing stud and existing floor joist act as a fuse in the event of an earthquake and fail first, thus preventing failure of other components of the assembly and defining capacity of the system improving collapse capacity of the building structure.

A plurality of these systems, knee-brace frames, is installed at strategic location in the building and at stud spacing intervals, the number depends on the desired degree of protection and physical space limitations.

BRIEF DESCRIPTION OF THE DRAWING FIGURES

DETAILED DESCRIPTION OF THE PREFERRED EMBODIMENT

Figure 1:
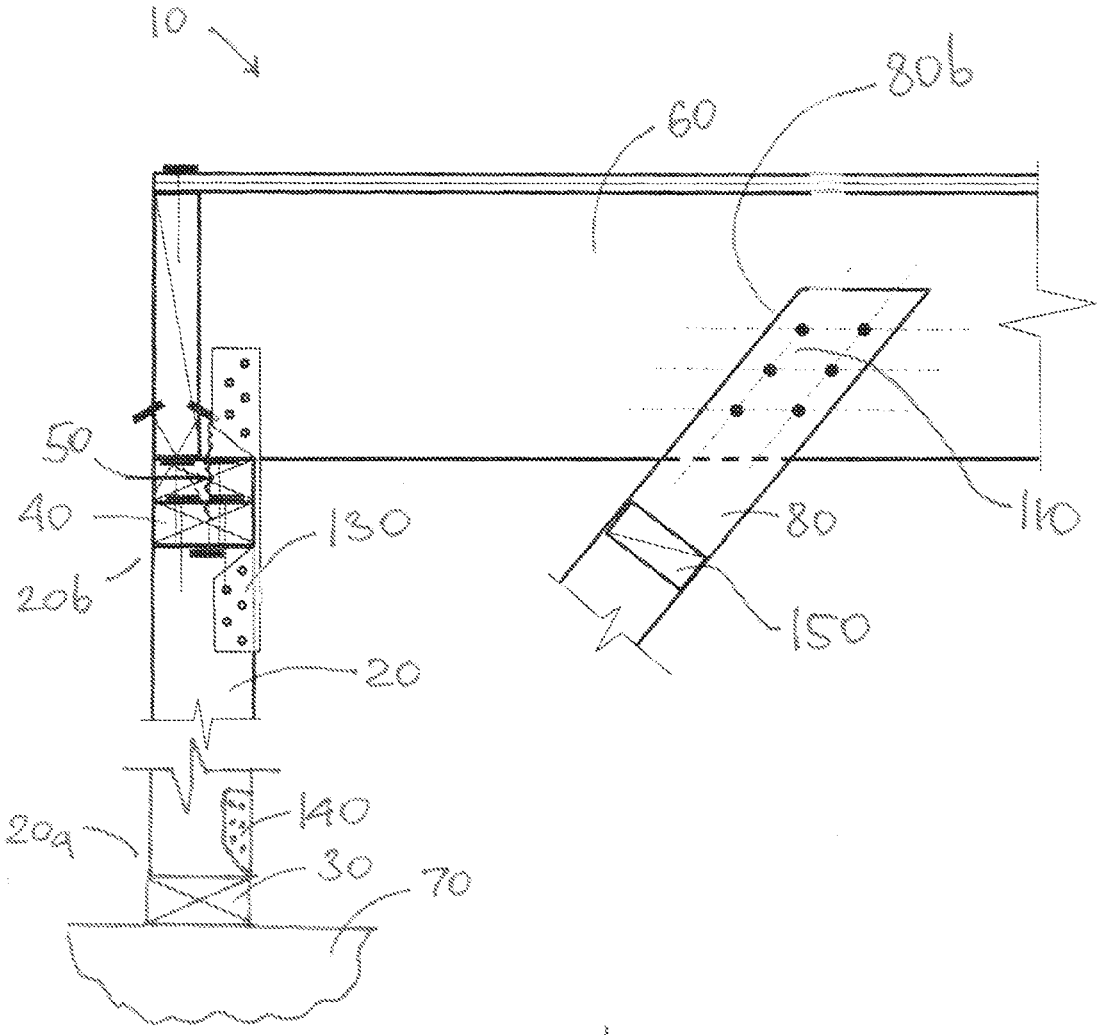
FIG. 1 shows an elevation view of a system according to the preferred embodiment of this invention.
Figure 2:
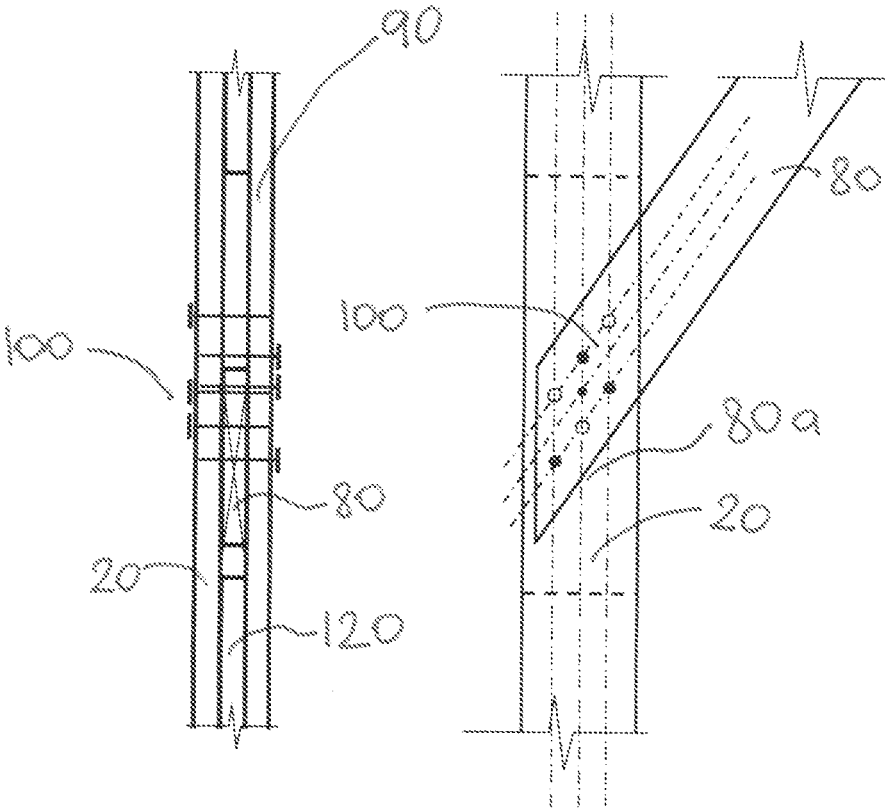
FIG. 2 shows an elevation view of a knee brace to existing floor joist connection in a system according to the preferred embodiment of this invention.
Figure 3:
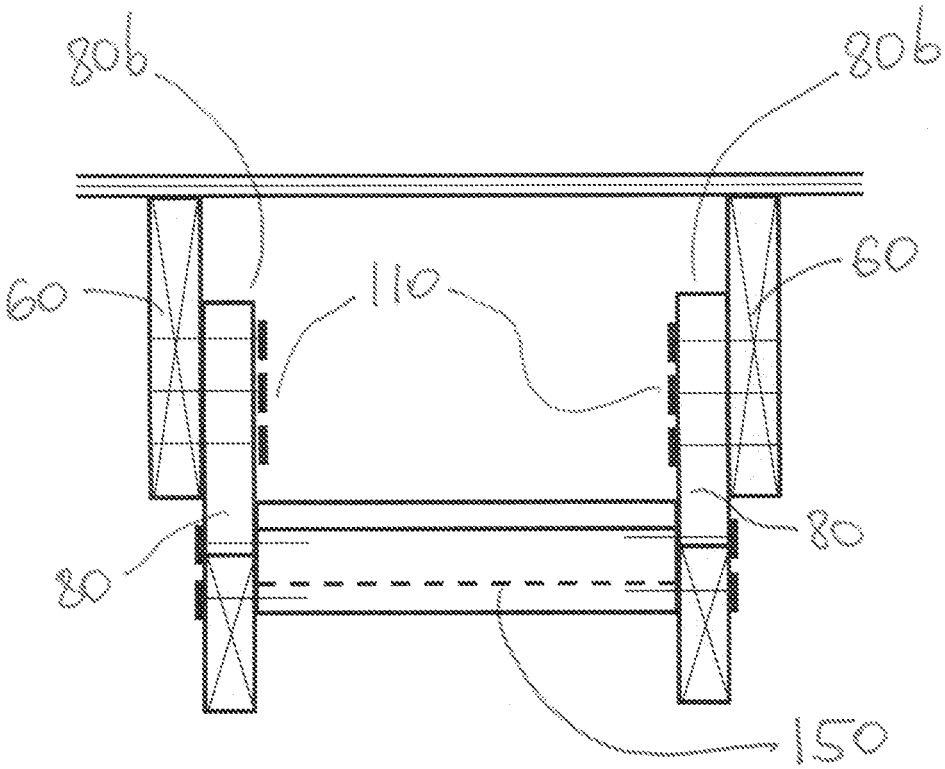
FIG. 3 shows an elevation view of a knee brace to existing stud connection in a system according to the preferred embodiment of this invention.

This invention will be better understood with the reference to FIG. 1 through FIG. 3. The same numerals indicate the same elements in all drawing figures.

Viewing, simultaneously, FIG. 1 through FIG. 3, numeral 10 indicates a support structure. A pair of identical support structures 10 is disposed in a mirror image arrangement, as particularly shown in FIG. 3.

Numeral 20 indicates an existing stud. An existing building structure has a plurality of existing studs 20, which are typically spaced 16" on center. Each existing stud 20 comprises a bottom end indicated by numeral 20*a* and a top end indicated by numeral 20*b*. Bottom end 20*a* is affixed to an existing bottom plate indicated by numeral 30. Top end 20*b* is affixed to an existing first top plate indicated by numeral 40. Existing first top plate 40 is affixed to an existing second top plate indicated by numeral 50. Existing second top plate 50 is affixed to an existing floor joist indicated by numeral 60. Existing bottom plate 30 is affixed to an existing foundation indicated by numeral 70.

Numeral 80 indicates a new knee brace. New knee brace 80 comprises a first end indicated by numeral 80*a* and a second end indicated by numeral 80*b*.

Numeral 90 indicates a new stud. New stud 90 is sized identically to existing stud 20. New stud 90 is disposed next to existing stud 20 between existing first top plate 40 and existing bottom plate 30. New stud 90 and existing stud 20 sandwich first end 80*a* substantially in the middle of existing stud 80 (i.e., the distance from bottom end 20*a* to first end 80*a* is substantially equal to the distance from first end 80*a* to top end 20*b*). This is done to maximize the vertical load carrying capacity.

Numeral 100 indicates a first new connection means. First new connection means 100 affixes first end 80*a* to existing stud 20 and to new stud 90. First new connection means 100 is configured to withstand a first force. First new connection means 100 is designed to 2 to 2.5 times the horizontal load on the frame and is based on seismic demand calculations for specific locations, the angle of new knee brace 80 and capacity of the connection times 1.3.

Numeral 110 indicates a second new connection means. Second new connection means 110 affixes second end 80*b* to the existing floor joist 60. Second new connection means 110 is configured to withstand a first force.

First new connection means 100 and second new connection means 110 are configured in such a way that the distance between top end 20*b* and first end 80*a* is substantially two times the distance between top end 20*b* and second end 80*b*.

Numeral 120 indicates a new spacer. New spacer 120 is sandwiched between existing stud 20 and new stud 90.

Numeral 130 indicates a new stud to joist connection means. New stud to joist connection means 130 affixes existing stud 20 to existing floor joist 60. New stud to joist connection means 130 is configured to permit rotation of existing floor joist 60 with respect to existing first top plate 40, existing second top plate 50 and existing stud 20. At the same time, new stud to joist connection means 130 is configured to prevent vertical separation of existing joist 60 from existing first top plate 40, existing second top plate 50 and existing stud 20 (i.e. it resists vertical uplift force yet the structural elements are free to rotate). The nails connecting existing joist 60 to the top plate prevent horizontal movement of the joist relative to the stud.

New stud to joist connection means 130 is configured to withstand a second force.

Numeral 140 indicates a new stud to bottom plate connection means. New stud to bottom plate connection means 140 is configured to permit rotation of existing bottom plate 30 with respect to existing stud 20.

At the same time, new stud to bottom plate connection means 140 is configured to prevent separation of existing bottom plate 30 from existing stud 20.

New stud to bottom plate connection means 140 is configured to withstand a second force.

The second force is at least 30% higher than the first force. It has been determined through experiment that the capacity of all other components of the system is based on the second force being at least 30% higher than the first force, it all works best to allow first new connection means 100 and second new connection means 110 to act as a fuse and fail first in the event of an earthquake, thus saving the building structure from developing less desirable non-ductile (or brittle) collapse mechanism.

Numeral 150 indicates a new block means. New block means 150 is disposed between new knee braces 80 in identical support structures 10 disposed in a mirror image arrangement. New block means 150 is bracing new knee braces 80, placed side by side on opposite side of the adjacent existing joist 60, against each other.

In the preferred embodiment described with reference to FIG. 1-3, first new connection means 100 and second new connection means 110 comprise six nails, said six nails being 0.131"×3.25" nails. In the case of first new connection means 100, three of said nails are applied from the side of new stud 90 and three of said nails are applied from the side of existing stud 20. The nails are spaced as a minimum such as to meet industry accepted requirements for preventing wood splitting. In the case of second new connection means 110, all six nails are applied from the side of new knee brace 80 following the same requirements.

Further, in the preferred embodiment described with reference to FIG. 1-3, new stud to joist connection means 130 comprises a hurricane tie, such as Simpson H2-A product. Also, new knee braces 80, new block means 150, new stud 90 and new spacer are 120 are each shown as formed of a 2×4 wood members.

At least one pair of identical support structures 10 must be used for earthquake retrofit. Usually, several pairs of identical support structures 10 are installed, depending on the level of protection desired. Obviously, a larger number of pairs of identical support structures 10 installed provides greater earthquake resistance.

In an alternative embodiment, combinations of singular support structures 10, rather than identical pairs thereof, are installed. The above description applies, with equal force, to singular support structures 10, except new block means 150 is not provided. A minimum of two support structures 10 must be used, but they do not need to be used in pairs.

While the present invention has been described and defined by reference to the preferred embodiment of the invention, such reference does not imply a limitation on the invention, and no such limitation is to be inferred. The invention is capable of considerable modification, alteration, and equivalents in form and function, as would occur to those ordinarily skilled and knowledgeable in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

I claim:

1. A system for earthquake retrofit of an existing building structure, said existing building structure having a plurality of existing studs each comprising a bottom end affixed to an existing bottom plate and a top end affixed to an existing first top plate, said existing bottom plate affixed to an existing foundation and said existing first top plate affixed to an existing second top plate, which is affixed to an existing floor joist, the system comprising a pair of identical support structures disposed in a mirror image arrangement, each of said support structures comprising:

a new knee brace;

a new stud;

a new spacer;

a first new connection means;

a second new connection means;

a new stud to joist connection means;

a new stud to bottom plate connection means;

a new block means;

wherein the new knee brace comprising a first end and a second end;

wherein the new stud sized identically to the existing stud, said new stud disposed next to the existing stud between the existing first top plate and the existing bottom plate, such that the new stud and the existing stud sandwiching the first end substantially in a middle of the existing stud;

wherein the first new connection means affixing the first end to the existing stud and to the new stud, said first new connection means configured to withstand a first force;

wherein the second new connection means affixing the second end to the existing floor joist, said second new connection means configured to withstand the first force;

wherein the distance between the top end and the first end is substantially twice the distance between the top end and the second end;

wherein the new spacer sandwiched between the existing stud and the new stud;

wherein the new stud to joist connection means affixing the existing stud to the existing floor joist, such that the new stud to joist connection means configured to permit rotation of the existing floor joist with respect to the existing first top plate, the existing second top plate and the existing stud, such that the new stud to joist connection means configured to prevent separation of the existing joist from the existing first top plate, the existing second top plate and the existing stud, such that the new stud to joist connection means configured to withstand a second. force;

wherein the new stud to bottom plate connection means configured to permit rotation of the existing bottom plate with respect to the existing stud, such that the new stud to bottom plate connection means configured to prevent separation of the existing bottom plate from the existing stud, such that the new stud to bottom plate connection means configured to withstand a second force;

wherein the new block means disposed between the new knee braces in the identical support structures disposed in a mirror image arrangement and bracing the new knee braces against each other;

wherein the second force is at least 30% higher than the first force.

2. A system as in claim 1 wherein the first new connection means and the second new connection means comprise six nails, said six nails having a diameter of 0.131" and a length of 3.25".

3. A system as in claim 2 wherein the new stud to joist connection means comprises a hurricane tie.

4. A system as in claim 3 wherein the new knee braces, the new block means, the new stud and the new spacer are each formed of a 2×4 wood members.

5. A system for earthquake retrofit of an existing building structure, said existing building structure having a plurality of existing studs each comprising a bottom end affixed to an existing bottom plate and a top end affixed to an existing first top plate, said existing bottom plate affixed to an existing foundation and said existing first top plate affixed to an existing second top plate, which is affixed to an existing floor joist, the system comprising:

a new knee brace;

a new stud;

a new spacer;

a first new connection means;

a second new connection means;

a new stud to joist connection means;

a new stud to bottom plate connection means;

wherein the new knee brace comprising a first end and a second end;

wherein the new stud sized identically to the existing stud, said new stud disposed next to the existing stud between the existing first top plate and the existing bottom plate, such that the new stud and the existing stud sandwiching the first end substantially in a middle of the existing stud;

wherein the first new connection means affixing the first end to the existing stud and to the new stud, said first new connection means configured to withstand a first force;

wherein the second new connection means affixing the second end to the existing floor joist, said second new connection means configured to withstand the first force;

wherein the distance between the top end and the first end is substantially twice the distance between the top end and the second end;

wherein the new spacer sandwiched between the existing stud and the new stud;

wherein the new stud to joist connection means affixing the existing stud to the existing floor joist, such that the new stud to joist connection means configured to permit rotation of the existing floor joist with respect to the existing first top plate, the existing second top plate and the existing stud, such that the new stud to joist connection means configured to prevent separation of the existing joist from the existing first top plate, the existing second top plate. and the existing stud, such that the new stud to joist connection means configured to withstand a second force;

wherein the new stud to bottom plate connection means configured to permit rotation of the existing bottom plate with respect to the existing stud, such that the new stud to bottom plate connection means configured to prevent separation of the existing bottom plate from the existing stud, such that the new stud to bottom plate connection means configured to withstand a. second force;

wherein the second force is at east 30% higher than the first force.

6. A system as in claim 5 wherein the first new connection means and the second new connection means comprise six nails, said six nails having a diameter of 0.131" and a length of 3.25".

7. A system as in claim 6 wherein the new stud to joist connection means comprises a hurricane tie.

8. A system as in claim 7 wherein the new knee braces, the new stud and the new spacer are each formed of a 2×4 wood members.

* * * * *